US009470073B2

(12) United States Patent
Xiao et al.

(10) Patent No.: US 9,470,073 B2
(45) Date of Patent: Oct. 18, 2016

(54) DOWNHOLE FLUID TRANSPORT PLUNGER WITH MOTOR AND PROPELLER AND ASSOCIATED METHOD

(71) Applicant: Saudi Arabian Oil Company, Dhahran (SA)

(72) Inventors: Jinjiang Xiao, Dhahran (SA); Abubaker Saeed, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 544 days.

(21) Appl. No.: 13/910,685

(22) Filed: Jun. 5, 2013

(65) Prior Publication Data

US 2013/0319661 A1 Dec. 5, 2013

Related U.S. Application Data

(60) Provisional application No. 61/655,745, filed on Jun. 5, 2012.

(51) Int. Cl.
*E21B 43/12* (2006.01)

(52) U.S. Cl.
CPC ..... *E21B 43/121* (2013.01)

(58) Field of Classification Search
CPC . E21B 2023/008; E21B 23/08; E21B 43/121
See application file for complete search history.

(56) References Cited

U.S. PATENT DOCUMENTS 4,211,279 A 7/1980 Isaacks
4,616,719 A 10/1986 Dismukes
4,676,310 A * 6/1987 Scherbatskoy ..... E21B 23/10 166/113
5,127,803 A 7/1992 Walter
6,148,923 A 11/2000 Casey
6,170,573 B1 1/2001 Brunet et al.
6,176,309 B1 1/2001 Bender
6,360,823 B1 3/2002 Ranson et al.
6,378,627 B1 4/2002 Tubel et al.
6,637,510 B2 10/2003 Lee
6,799,633 B2 10/2004 McGregor
6,953,094 B2 10/2005 Ross et al.
6,971,265 B1 12/2005 Sheppard et al.
7,134,503 B2 * 11/2006 Lee ..... F04B 47/12 166/105
7,219,725 B2 5/2007 Chisholm
7,438,125 B2 10/2008 Victor
7,445,048 B2 11/2008 Sheffield
2006/0090893 A1 5/2006 Sheffield
2010/0294507 A1 11/2010 Tanton

OTHER PUBLICATIONS

PCT International Search Report and the Written Opinion of the International Searching Authority dated Jun. 17, 2014; International Application No. PCT/US2013/044213; International File Date: Jun. 5, 2013.

* cited by examiner

*Primary Examiner* — David Andrews
*Assistant Examiner* — Kristyn Hall
(74) *Attorney, Agent, or Firm* — Bracewell LLP; Constance Gall Rhebergen

(57) ABSTRACT

A method for lifting fluids within a subterranean well includes lowering an elongated plunger to a lower region of a bore of the subterranean well. The plunger includes a motor assembly operably connected to a propeller. A seal can be created between the plunger and an inner surface of the bore of the subterranean well. A thruster, such as motor assembly connected to a propeller, generates thrust to lift the plunger to a plunger retainer located proximate to a wellhead of the subterranean well.

10 Claims, 3 Drawing Sheets

DOWNHOLE FLUID TRANSPORT PLUNGER WITH MOTOR AND PROPELLER AND ASSOCIATED METHOD

PRIORITY CLAIM

This application claims priority to U.S. Provisional Patent Application No. 61/655,745 titled "Downhole Fluid Transport Plunger with Motor and Propeller," filed on Jun. 5, 2012, the disclosure of which is incorporated herein by reference in its entirety.

BACKGROUND OF THE INVENTION

1. Field of the Invention

The general field of the invention is artificial lift, in particular, plunger lift systems to move liquids upward in a subterranean well.

2. Description of the Related Art

Subterranean wells typically produce both liquids and gasses. Gas wells will therefore produce liquids, such as fresh water, salt water, or condensate, with the gas flow. A problem arises when liquids accumulate in the well bore of a gas well. The liquids in the wellbore will hold back and eventually stop the flow of gas to the wellbore and therefore stop production of gas to the surface. This is known as liquid loading. Liquid loading in the wellbore is often a serious problem especially in mature gas wells.

Chemical soaping, velocity string, and plunger lift are some of the techniques currently used to overcome liquid loading. Soap sticks can be dropped into the well. They produce foaming and thus reduce the fluid column hydrostatic pressure to keep the well producing. This is known as chemical soaping. As the well rate declines, slim tubing, such as a 2⅛" tubing can be used to replace the regular tubing so that gas velocity can be increased to effectively carry liquids out of the well. This is also known as velocity string. However when the reservoir pressure declines further, chemical soaping and velocity string may no longer work. Plunger lifting has proven to be a cost effective way to improve such wells' productivity.

Plunger lift is currently used as a method of removing liquids from the wellbore using the formation gas as the energy source. Therefore a substantial amount of formation gas pressure is required to create enough force to push the plunger from the bottom of the well to the surface. The required pressure is often achieved by shutting in the well, sometimes for significant periods of time, while the gas accumulates in the annuals. This results in loss of production. In addition, the procedure may need to be performed multiple times a day, which means that the well would have to be shut on and off multiple times in a 24 hour period, further reducing the hours in a day in which the well can be producing.

If production packers are used to prevent hydrocarbons in the tubing casing annulus, for example as a safety measure, the gas would not be able to accumulate in the annulus above the packers. Because of the relatively limited space available in the annulus near the bottom of the bore hole, the volume of accumulated gas may not be sufficient to achieve the needed pressure. In addition, for mature wells with declining production rates, the drop in pressure of the well fluids will reach a point where it's not possible to build up pressure to perform conventional plunger lifting. Therefore even if wells are shut in, there are also situations where current plunger lift technology will not work.

SUMMARY OF THE INVENTION

Applicants have recognized that while plunger lift is a relatively low capital and low maintenance cost artificial lift method, there is a need to find a method of lifting liquids from a wellbore that can take place without shutting in the well for prolonged periods of time. It would also be desirable to find a method of lifting liquids in wells where pressure buildup, alone, is insufficient to push the plunger and liquids to the surface.

The present invention discloses a new method and apparatus for plunger lift systems to increase gas production as well as increase efficiency in removing liquid loading while allowing the wells to continuously produce through the duration of the method. This invention will minimize or eliminate the need for shutting in the well for prolonged periods of time to build up the pressure necessary to lift the plunger. This invention will allow for as many trips as needed for the plunger to efficiently deliquify gas wells or to remove solid buildup, such as scale and asphaltene, and swab other solid accumulations within the wellbore. Existing passive system methods strictly depend on building up pressure to lift the plunger. Embodiments of this invention instead use a propulsion system, such as a motor driving a propeller, which adds energy to the well fluids and creates the additional pressure difference required to lift the plunger and fluids. This invention can prolong the life of the well beyond what is achievable with current plunger lift systems.

In embodiments of the present invention, a method for lifting fluids within a subterranean well can include the steps of lowering an elongated plunger to a lower region of a bore of the subterranean well, the plunger comprising a motor assembly operably connected to a propeller. A seal is created between the plunger and an inner surface of the bore of the subterranean well. The propeller then can be rotated by activating the motor assembly to lift the plunger to a lubricator assembly located above a wellhead of the subterranean well. Fluid trapped in the bore above the plunger can be lifted to a flowline above the wellhead. These steps can occur simultaneously with the continued delivery of production fluids to the wellhead.

In some embodiments, the motor assembly can be operably connected to a rechargeable battery. The lubricator assembly can include a battery charging station for recharging the rechargeable battery. Recharging the rechargeable battery can be performed by a wet mate connection, an inductive coupling or an alternative wireless means, as will be understood by those will skill in the art.

In alternative embodiments, the plunger can include a data collection means for collecting data within the subterranean well. Temperature, pressure and liquid level data may be collected. The plunger can alternatively include a plunger controller operably connected to the motor, wherein the step of activating the motor assembly includes signaling the plunger controller to activate the motor assembly. The data collection means can measure the liquid level above the plunger and signal the plunger controller to activate the motor when the data collection means measures a liquid level greater than a pre-set amount.

In alternative embodiments of the present invention, an apparatus for lifting fluids within a subterranean well includes an elongated plunger with at least one circumferential sealing means operable to create a seal between the elongated plunger and an inner surface of a bore of the subterranean well. The plunger can have a motor assembly and a propeller.

In certain embodiments, the motor assembly can be operably connected to a rechargeable battery operable to provide power to the motor. The apparatus can further include a lubricator assembly, the lubricator assembly including a battery charging station for recharging the rechargeable battery. In other embodiments, the plunger can have a data collection means, the data collection means operable to collect data selected from the group consisting of temperature, pressure and liquid level. In still other embodiments, the plunger can have a valve member, the valve member when in an open position being operable to allow fluid within the bore of the subterranean well to flow from a one end of the plunger to an opposite end of the plunger. The plunger may have a plunger controller operable to activate the motor.

Embodiments of a method for lifting fluids within a subterranean wellbore can include the steps of positioning an elongated self-propelled plunger in the wellbore, the plunger having a thruster and a power supply, the power supply being operatively connected to the thruster; causing the plunger to descend to a lower region of the wellbore; actuating the thruster, the thruster accelerating a wellbore fluid in a downward direction to urge the plunger upward toward the surface of the earth; displacing wellbore fluid toward the surface of the earth as the plunger moves upward in the wellbore; and catching and supporting the plunger in a plunger receiver.

In embodiments, the plunger can descend until it lands on a bumper. In embodiments, the thruster can be actuated in response to the plunger landing on the bumper. The power supply can include a rechargeable battery and the plunger receiver further can include a battery charging station, the battery being recharged when the plunger is positioned in the plunger receiver. In embodiments, the plunger can include a data collection means, and the method can include the step of collecting data within the subterranean well. In embodiments, the plunger can include a data collection means operable to measure the liquid level above the plunger, and the controller can actuate the thruster when the data collection means measures a liquid level greater than a pre-set amount. In embodiments, the wellbore can include a tubular member having an inner diameter surface, and the method can include the step of creating a seal between the plunger and the inner diameter surface. The step of creating a seal between the plunger and the inner diameter surface can trap fluids in the wellbore above the plunger and the step of lifting the plunger to the plunger retainer includes lifting the trapped fluids to a flowline above a wellhead connected to the wellbore. In embodiments, the plunger can include a valve operable to selectively flow fluid between a lower and an upper end of the plunger, wherein the valve is open to permit fluid flow while the plunger descends and the valve is in a closed position to block fluid flow while the plunger ascends.

Embodiments of a self-propelled plunger for lifting fluids within a subterranean well can include a plunger body having an upper end and a lower end; a power supply capable of storing energy, at least a portion of the power supply being positioned within the plunger body; and a thruster, the thruster being operatively connected to the power supply and operable to accelerate a fluid in the direction of the lower end to urge the plunger in the direction of the upper end.

In embodiments, the plunger includes at least one circumferential sealing means operable to create a seal between the plunger body and an inner surface of a tubular member. The thruster can include a motor assembly operably connected to a propeller and/or a fluid jet propulsion motor.

In embodiments, the power supply comprises a rechargeable battery. Embodiments can include a data collection means, the data collection means operable to collect data selected from the group consisting of temperature, pressure, and liquid level. Embodiments of the plunger can include a valve member, the valve member operable to selectively flow fluid between the upper end and the lower end of the plunger body.

Embodiments of a system for conditioning a wellbore can include a wellbore having an axially extending tubular member positioned therein; a self-propelled plunger operable to be positioned within the tubular member, the plunger having a plunger body having an upper end and a lower end, a power supply, at least a portion of the thruster being positioned within the plunger body, and a thruster, the thruster being operatively connected to the power supply and operable to accelerate a fluid in the direction of the lower end; a plunger receiver positioned at an upper end of the tubing; and a bumper positioned within the tubing and spaced axially apart, along the wellbore, from the plunger retainer, the bumper being operable to prevent the plunger from descending axially past the bumper.

In embodiments, the power supply includes a rechargeable battery and the plunger receiver includes a battery charging station, the battery charging station recharging the battery when the plunger is retained by the plunger retainer.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings, which illustrate various embodiments of the invention. This invention, however, may be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
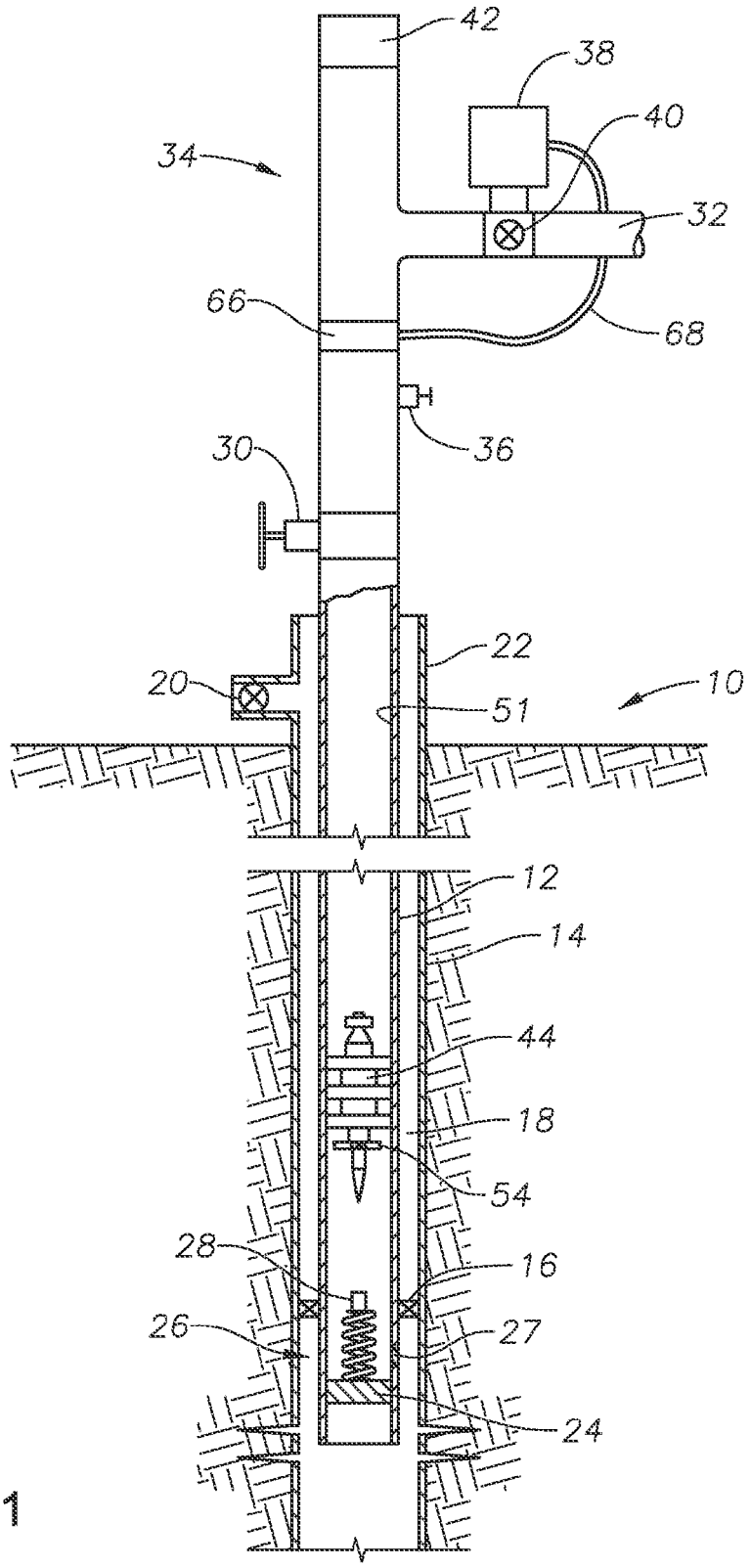
FIG. 1 is a partial sectional view of the apparatus according to an embodiment of the present invention.

As seen in FIG. 1, according to an embodiment of the present invention, subterranean well 10 can include production tubing 12 located concentrically within well casing 14. Each of tubing 12 and well casing 14 are considered tubular members. Production packers 16 are sealingly engaged between well casing 14 and production tubing 12 to prevent fluids, such as hydrocarbons, from entering annulus 18 located between an inner surface of well casing 14 and an outer surface of production tubing. Casing valve 20 located in proximity to the wellhead 22 provides a means of access between annulus 18 and the exterior of the well 10. In alternative embodiments, there may be no production packers between the well casing 14 and production tubing 12 and well fluids could flow within annulus 18. In other alternative embodiments, production tubing may not be used and production fluids may instead travel through well casing 14. In such embodiments, production packers 16 would not be used.

Tubing stop 24 is supported in lower region 26 of production tubing 12. Fluids may enter production tubing 12 through a standing valve or check valve in tubing stop 24. Alternatively, fluids can enter production tubing 12 by way of openings 27 through production tubing 12 which are located above tubing stop 24 and below production packers 16. A bumper can be located in tubing 12 and can be used to slow or stop the descent of an object through tubing 12. The bumper can include, for example, tubing stop 24 and a lower bumper spring 28 located above tubing stop 24. Tubing stop 24 and lower bumper spring 28 may be a single component or two separate components. In alternative embodiments, a seating nipple with a bumper means can be used as a bumper.

Above wellhead 22, master valve 30, when in an open position, allows fluids from the well to pass upwards through production tubing 12 to reach production flowline 32, which is part of lubricator 34. When in the open position, master valve 30 also allows tools, wireline, and other components to pass from lubricator 34 to tubing 12. When closed, master valve 30 prevents flow into and out of production tubing 12.

Lubricator 34 is in fluid communication with an upper end of production tubing 12. A person of ordinary skill will understand that a lubricator is an upper valve on a Christmas tree that provides access to the wellbore. Lubricator 34 also includes a plunger receiver 36, and a lubricator control unit 38. As will be described in more detail, receiver 36 is a retainer that can catch and retain a plunger as the plunger moves up into lubricator 34. In embodiments, receiver 36 can selectively release the plunger. Control unit 38 may control a flowline valve 40 in production flowline 32. Lubricator 34 may also include an upper bumper spring 42.

Figure 2:
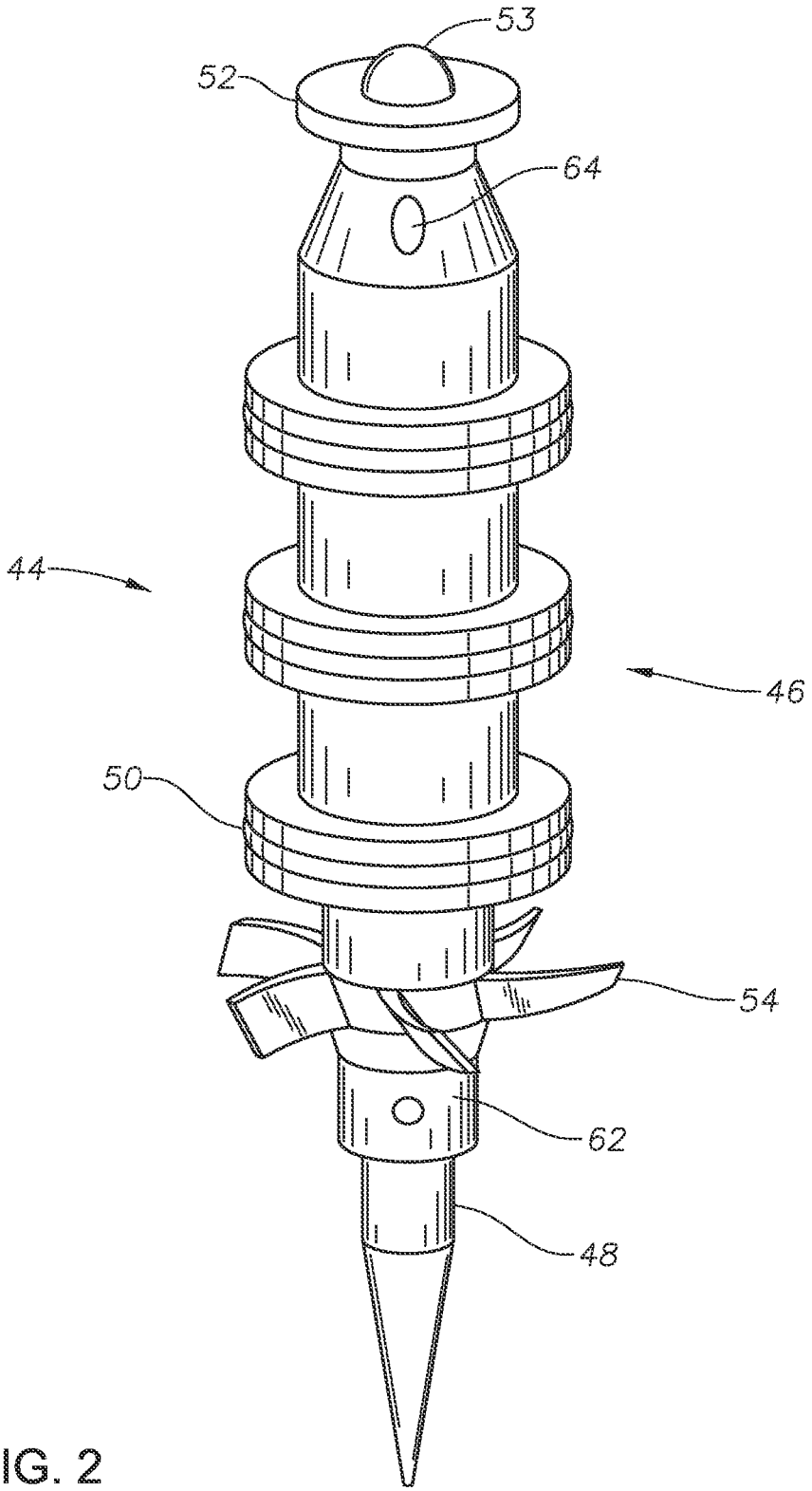
FIG. 2 is a perspective view of the plunger of the apparatus of FIG. 1 according to an embodiment of the present invention.
Figure 3:
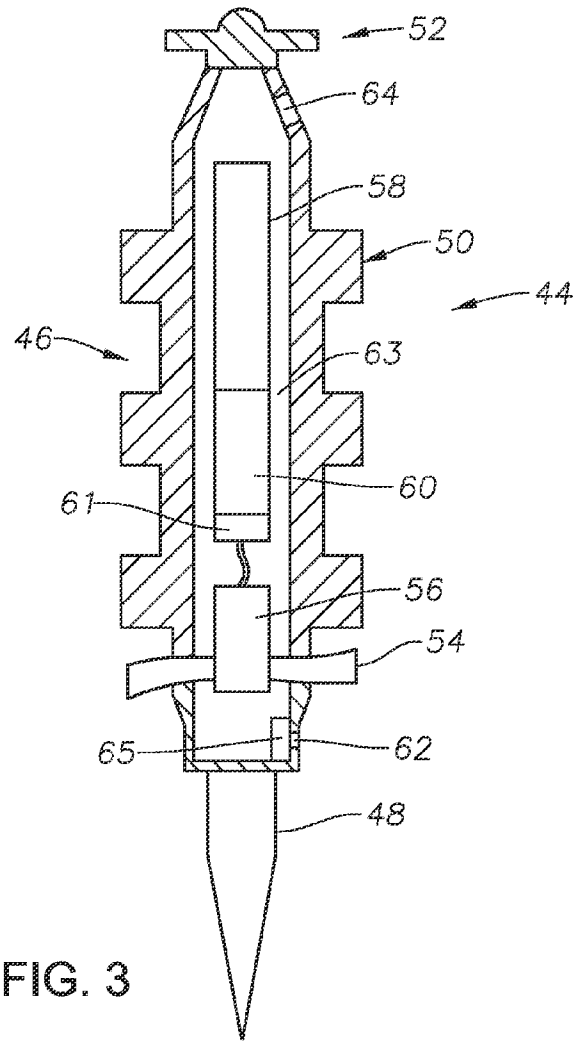
FIG. 3 is a sectional view of the plunger of the apparatus of FIG. 1 according to an embodiment of the present invention.

Looking now at FIG. 1-3, a self-propelled plunger 44 includes an elongated cylindrical plunger body 46. At a bottom end of the plunger body 46 is a bottom contact portion 48. Bottom portion 48 may be a cylindrical member with a reduced diameter, as shown in FIG. 2, or may be any other suitable configuration to mate with lower bumper spring 28. Sealing means 50 are supported by plunger body 46. Sealing means 50 are circumferential and can have an outer diameter that is substantially similar to the inner diameter surface 51 of tubing 12. Sealing means 50 are operable to sealingly engage an inner diameter surface of a tubular member, such as tubing 12 or casing 14. Sealing means 50 may include multiple sealing rings. In alternative embodiments, sealing means 50 may be pads or other sealing components known in the art. At a top end of plunger body 46 is a top contact portion 52. Contact portion 52 may include a disk shaped component with a semicircular protrusion 53, or may be of any alternative configuration suitable for mating with upper bumper spring 42.

Plunger 44 also includes a thruster for thrusting, or propelling, plunger 44 through a fluid medium. In embodiments, the thruster can include a propeller 54 operably connected to a motor assembly 56. Other types of thruster can be used to propel plunger 44 through a tubular member. Plunger 44 can have a power supply 58 for providing power to the thruster. In embodiments, power supply 58 can include a battery. The motor assembly 56 may be operably connected to power supply 58. Power supply 58 may be rechargeable. The thruster can propel plunger 44 through the wellbore without requiring a tether, such as a cable, connected to the plunger 44 and leading to, for example, the surface of the earth. Indeed, no cable, or tether, is required to, for example, pull plunger 44 through the wellbore or to provide power to plunger 44 so there is an absence of a tether connected to plunger 44. Plunger 44, thus, is considered to be untethered. The power supply and thruster are both a part of plunger 44, so plunger 44 can propel itself through a fluid medium and, thus, plunger 44 is self-propelled.

In the embodiment of FIGS. 2 and 3, plunger 44 also includes one or more sensor units 60. One or more of the sensor units 60 may be connected to or be a component of a plunger controller 61 which is operable to activate the thruster, such as motor assembly 56. Sensor unit 60 can detect various parameters including, for example, whether plunger 44 is landed on the bumper. Various sensor units 60 can also detect wellbore parameters including, for example, temperature, pressure, and the level of liquid within the wellbore. Sensor unit 60 or controller 61 can also include a data collection means to collect data such as temperature, pressure, and liquid level. The collected data can be used to determine when to actuate the thruster and, in embodiments, can be stored or transmitted to the surface for use in subsequent wellbore analysis and monitoring.

In embodiments, plunger 44 can selectively communicate fluid from an area at one end of plunger 44, such as below plunger 44, to an area at the other end of plunger 44, such as an area above plunger 44. In embodiments, plunger 44 can include a lower aperture 62 and an upper aperture 64. A fluid passage 63 can communicate fluid between lower aperture 62 and upper aperture 64. A valve 65 can selectively pass fluid through fluid passage 63. In embodiments, valve 65 is located proximate to lower aperture 62, but valve 65 can be located anywhere between lower aperture 62 and upper aperture 64.

Plunger 44 can include a valve means. In the embodiment of FIG. 2, the valve means includes lower aperture 62 and an upper aperture 64. When valve 65 is open, lower aperture 62 is in fluid communication with upper aperture 64. When open, valve 65 will allow fluids to flow into and through lower aperture 62 and continue out of upper aperture 64. When closed, valve 65 prevents fluids from passing between lower aperture 62 and upper aperture 64. Valve means can include other techniques to selectively communicate fluid from the area in the vicinity of one end of plunger 44 to the area in the vicinity of the other end of plunger 44, or from the area below plunger 44 to the area above plunger 44. For example, in embodiments, all or a portion of sealing means can retract or otherwise create a gap between plunger body 46 and the inner diameter surface of the tubular member in which it is located, thus permitting fluid to flow from an area below plunger 44 to an area above plunger 44. Other embodiments for allowing fluids to flow from the bottom end of plunger 44 to the top end of plunger 44 will be known to those of ordinary skill in the art.

Figure 4:
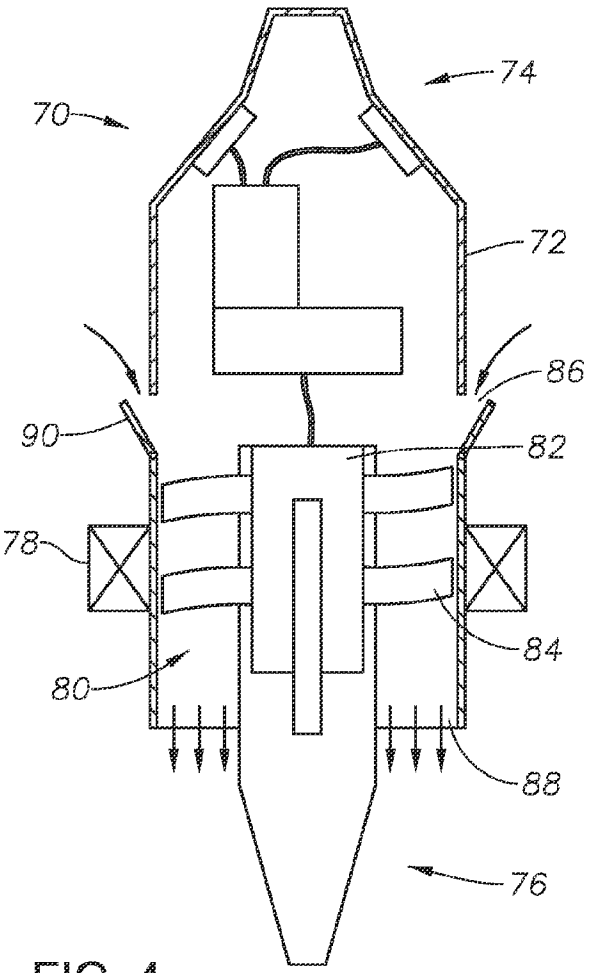
FIG. 4 is a sectional view of a plunger having a fluid jet thruster according to an embodiment of the present invention.

Referring now to FIG. 4, an embodiment of a plunger 70 is shown. Plunger 70 includes a plunger body 72, which can be a cylindrical body or can be other shapes. Plunger body 72 has an upper end 74 and a lower end 76. For purposes of this application, upper and lower is for descriptive purposes only and refers to an orientation of plunger 70 in a vertical well, with the understanding that plunger 70 can be in other orientations and can be used in deviated wells.

Seals 78 protrude outward from plunger body 72. Seals 78 can be circumferential seals and can sealingly engage the inner diameter of a tubular member, such as the inner diameter of casing or tubing. In embodiments, seals 78 can have a fixed position so that seals 78 engage a tubular member having a particular inner diameter. In embodiments, seals 78 can be retractable to selectively sealingly engage a tubular member or to sealingly engage tubular members of various inner diameters. In an extended position, seals 78 engage the tubular member and in a retracted position, seals 78 do not engage the tubular member.

Plunger 70 can include a thruster 80. Thruster 80 can accelerate a fluid in the direction of the lower end to urge the plunger in the direction of the upper end. Thruster 80 can be a fluid jet propulsion thruster as shown in FIG. 4. In such embodiments, plunger 44 can include, for example, a pump-jet, a hydro-jet, or a water jet. A fluid jet propulsion thruster can include a motor 82 and an internal propeller 84. One of skill in the art will appreciate that thruster 80 can include other types of fluid jet propulsion thrusters or can include an external propeller as shown in FIG. 3. One or more fluid inlets 86 admit fluid into an intake of thruster 80. Thruster 80 accelerates the fluid and discharges the fluid through outlet 88. The fluid is discharged with sufficient force to generate thrust, the thrust being great enough to propel plunger 70 upward, in the direction of the upper end 74. Inlets 86 can include a valve, such as a valve door 90 that covers inlet 86, to selectively allow fluid to pass through inlet 86. Fluid from the vicinity of upper end 74, external to plunger 70, can be accelerated by thruster 80 and discharged in the vicinity of lower end 76, external to plunger 70. In embodiments having a seal 78, inlet 86 can be located above seal 78 and outlet 88 can be located below seal 78. In embodiments having an internal thruster 80, as shown in FIG. 4, fluid from lower end 76 can enter through outlet 88, pass upward through thruster 80 (when thruster 80 is not accelerating fluid), and exit through inlet 86. This reverse flow can allow plunger 70 to descend through a fluid filled tubular member. When thruster 80 is activated and accelerates fluid, fluid passes in the opposite direction—from inlet 86 through thruster 80 and out through outlet 88. A valve, such as valve doors 90, can be closed to prevent fluid from passing through plunger 70 when thruster 80 is not activated.

Power supply 92 can provide power to thruster 80. All or at least a portion of power supply 92 can be located within plunger body 72. Power supply 92 can include a power storage device such as, for example, a battery, to store electric power and provide electricity to thruster 80. Controller 94 can cause power supply 92 to provide power to thruster 80. In embodiments, power supply 92 can include a rechargeable battery. The rechargeable battery can be recharged by a charger positioned in the wellbore. For example, plunger receiver 36 (FIG. 1), which can be part of a lubricator assembly, can include the charger.

Plunger 70 can include various sensors to detect wellbore conditions and information about plunger 70. Bottom sensor 96 can detect when plunger 70 is landed on a surface such as, for example, a bumper positioned within wellbore tubing. In embodiments, when bottom sensor 96 detects that plunger 70 has landed, bottom sensor 96 can send a signal to controller 94 indicating that plunger 70 has landed. Controller 94 can cause power supply 92 to provide power to thruster 80 immediately upon receiving such a landed signal or when specific conditions are met. For example, controller 94 can cause power supply 92 to provide power for a predetermined amount of time after plunger 70 has landed.

Other sensors 98 can be used to detect wellbore conditions. Sensors 98 can include one or move of various types of sensors such as, for example, pressure, temperature, pH, fluid presence, fluid type, and liquid level. Sensors 98 can also include position sensors for determining the location or depth of plunger 70. In embodiments, sensors 98 can provide data signals to controller 94 so that controller 94 can determine the liquid level or depth of fluid in the wellbore as plunger 70 descends through the wellbore. In embodiments, controller 94 can determine the pressure in the wellbore and, using that pressure data, estimate the liquid level for a given depth. Controller 94 can use the measured and calculated wellbore parameters to determine when to actuate thruster 80. For example, when the liquid level reaches a preselected level, controller 94 can cause power supply 92 to provide power to thruster 80.

In operation, plunger 44 is lowered into production tubing 12. This may take place while the well 10 continues to produce hydrocarbons and both the master valve 30 and flowline valve 40 are in an open position. Plunger 44 descends to the bottom of tubing 12 where it lands on a bumper. In embodiments, the bumper can include lower bumper spring 28. In embodiments, gravity alone causes plunger 44 to descend through tubing 12. In order to facilitate the flow of fluid past the plunger 44 as the plunger 44 moves down through tubing 12, valve 65 is in the open position. The bumper, including, for example, bumper spring 28, cushions the impact of plunger 44. During its downward descent, sensor unit 60 may collect data, such as temperature, pressure and liquid levels, with its data collection means.

Sealing means 50 are sealingly engaged with the inner diameter surface of tubing 12. After the plunger 44 reaches the lower bumper spring 28, valve 65 may immediately close to prevent additional fluids from moving past the plunger 44 and up through tubing 12. The motor assembly 56 may then be activated. Motor assembly 56 drives propeller 54, causing propeller 54 to rotate and generate sufficient thrust, which together with any residual pressure in the well, will lift the plunger and the fluids trapped above the plunger 44. By adding energy to the plunger system with the propeller 54, wells with high back-pressure due to long distance flowlines can be produced when conventional plunger lift can no longer work.

Alternatively, valve 65 may remain open after the plunger 44 reaches the lower bumper spring 28. Fluids within the well can then continue to enter the lower region 26 of the production tubing 12, pass by plunger 44 and continue up production tubing 12. Sensor unit 60 may collect liquid level data and when a pre-set liquid level is reached, valve 65 would then close to prevent further fluids from travelling past plunger 44. The plunger controller 61 of sensor unit 60 may signal valve 65 to close or otherwise cause valve 65 to close. Controller 61 will then activate the motor assembly, causing propeller 54 to rotate and generate sufficient thrust to lift the plunger and the fluids trapped above the plunger 44.

As the plunger 44 rises up the production tubing 12, it pushes all of the fluids in production tubing 12 above plunger 44 up through tubing 12 and out through production flowline 32. As the plunger 44 rises up the production tubing 12, it may also remove solid buildup, such as scale, asphaltene, and swab other solid accumulations within the inner surface of tubing 12. When the plunger reaches lubricator 34, it contacts upper bumper spring 42. Upper bumper spring 42 cushions the impact of plunger 44.

Plunger receiver 36 will engage and support plunger 44 in the lubricator 34. Plunger receiver 36 may either be designed to automatically release plunger 44 when certain criteria are met, such as a given time interval has passed or a wellbore pressure setting is met. Alternatively, control unit 38 may be programmed to cause plunger receiver 36 to release plunger 44.

A battery charging station 66 of lubricator 34 can be used to recharge the power supply 58 while the plunger 44 is supported by plunger receiver 36 in the lubricator 34. Recharging can be done by a wet mate connection, an inductive coupling, or by other wireless means. In alternative embodiments, power supply 58 may not be rechargeable and an operator may replace power supply 58 when needed. A cable 68 can provide a means of communication between control unit 38 and plunger 44. Cable 68 can, for example, provide the power needed to recharge the battery 58 and can transmit data collected by sensor unit 62. In alternative embodiments sensor unit 62 can transmit the collected data by wireless means.

When the plunger 44 is supported in the lubricator, valve 65 can be opened to allow fluids to flow past plunger 44. When the well 10 is to be deliquified again, the process is repeated by causing plunger receiver 36 to release plunger 44, allowing plunger 44 to again fall to the bottom of the production tubing 12. This deliquifying process can be repeated as often and as many times as needed or desired.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method for lifting fluids within a subterranean wellbore, the method comprising the steps of:

(a) positioning an elongated self-propelled plunger in the wellbore, the plunger having a thruster and a power supply, the power supply being operatively connected to the thruster;

(b) causing the plunger to descend to a lower region of the wellbore;

(c) actuating the thruster, the thruster accelerating a wellbore fluid in a downward direction to urge the plunger upward toward the surface of the earth;

(d) displacing wellbore fluid toward the surface of the earth as the plunger moves upward in the wellbore; and (e) catching and supporting the plunger in a plunger receiver.

2. The method according to claim 1, wherein step (b) further comprises the step of landing the plunger on a bumper.

3. The method as defined in claim 2, wherein the thruster is actuated in response to the plunger landing on the bumper.

4. The method as defined in claim 1, wherein the power supply comprises a rechargeable battery and the plunger receiver further comprises a battery charging station, and wherein step (e) includes the step of recharging the rechargeable battery with the battery charging station.

5. The method as defined in claim 1, the plunger further including a data collection means, and the method further comprising the step of collecting data within the subterranean well.

6. The method as defined in claim 1, the plunger further including a data collection means operable to measure the liquid level above the plunger, wherein the step (c) includes actuating the thruster when the data collection means measures a liquid level greater than a pre-set amount.

7. The method as defined in claim 1, wherein the wellbore comprises a tubular member having an inner diameter surface, and further comprising the step of creating a seal between the plunger and the inner diameter surface.

8. The method as defined in claim 7, wherein the step of creating a seal between the plunger and the inner diameter surface traps fluids in the wellbore above the plunger and the step of lifting the plunger to the plunger retainer includes lifting the trapped fluids to a flowline above a wellhead connected to the wellbore.

9. The method as defined in claim 1, wherein steps (b)-(e) are each performed simultaneously with the continued delivery of production fluids from the wellbore.

10. The method as defined in claim 1, wherein the plunger comprises a valve operable to selectively flow fluid between a lower and an upper end of the plunger, wherein the valve is open to permit fluid flow in step (b) and the valve is in a closed position to block fluid flow during step (c).

* * * * *